US010236621B2

(12) United States Patent
Williams et al.

(10) Patent No.: US 10,236,621 B2
(45) Date of Patent: Mar. 19, 2019

(54) ELECTRICAL CONNECTOR WITH CONDUIT ADAPTER

(71) Applicant: Hubbell Incorporated, Shelton, CT (US)

(72) Inventors: Michael Williams, Watertown, CT (US); Roy Itzler, Orange, CT (US); Michael Salvietti, Northfield, CT (US); William Dietz, Branford, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/843,602

(22) Filed: Dec. 15, 2017

(65) Prior Publication Data

US 2018/0175544 A1 Jun. 21, 2018

Related U.S. Application Data

(60) Provisional application No. 62/434,654, filed on Dec. 15, 2016.

(51) Int. Cl.

| | |
|---|---|
| ***H01R 13/52*** | (2006.01) |
| ***H01R 13/625*** | (2006.01) |
| ***H01R 13/62*** | (2006.01) |
| ***H01R 24/28*** | (2011.01) |
| ***H01R 13/504*** | (2006.01) |
| ***H01R 13/622*** | (2006.01) |
| *H01R 105/00* | (2006.01) |

(52) U.S. Cl.

CPC ..... *H01R 13/5219* (2013.01); *H01R 13/5045* (2013.01); *H01R 13/5202* (2013.01); *H01R 13/622* (2013.01); *H01R 13/625* (2013.01); *H01R 13/6205* (2013.01); *H01R 24/28* (2013.01); *H01R 2105/00* (2013.01)

(58) Field of Classification Search

CPC ..... H01R 13/5219; H01R 13/625; H01R 13/6205; H01R 24/28; H01R 2105/00

USPC ..... 439/275

See application file for complete search history.

(56) References Cited

U.S. PATENT DOCUMENTS 2,738,477 A * 3/1956 Matthysse ..... H01R 13/28 24/583.11

3,065,448 A * 11/1962 Hopkins ..... H01R 13/422 439/872

(Continued)

OTHER PUBLICATIONS

Hubbell Wiring Device-Kellems, Metallic Liquidtight Conduit Fittings, publicly available before Dec. 2016 (2 pages).

(Continued)

*Primary Examiner* — Abdullah A Riyami
*Assistant Examiner* — Vladimir Imas
(74) *Attorney, Agent, or Firm* — Michael Best & Friedrich, LLP

(57) ABSTRACT

An electrical connector is provided that includes a housing defining a cavity and an aperture extending into the cavity. The electrical connector further includes an electrical contact supported by the housing, in which the electrical contact is electrically connected with a conductor. The electrical connector further includes a conduit fitting assembly connecting a conduit to the housing. The conduit feeds the conductor into the cavity of the housing through the aperture via the conduit fitting assembly.

24 Claims, 18 Drawing Sheets

(56) References Cited

U.S. PATENT DOCUMENTS 3,097,906 A * 7/1963 Shannon ..... H01R 11/22 439/224
3,124,406 A * 3/1964 Cook ..... H01R 29/00 439/320
3,413,407 A * 11/1968 Potter ..... H02G 15/085 174/77 R
3,501,737 A * 3/1970 Davy ..... H01R 9/0521 439/584
3,675,184 A * 7/1972 Vetter ..... H01R 13/59 439/462
4,373,767 A * 2/1983 Cairns ..... H01R 13/523 439/199
4,480,887 A * 11/1984 Morelli ..... H01R 13/646 439/275
4,618,198 A * 10/1986 Dale ..... H01R 13/5219 285/334.4
4,986,764 A * 1/1991 Eaby ..... H01R 13/53 439/275
5,364,285 A * 11/1994 Sakurai ..... H01R 13/5205 439/275
6,669,502 B1 * 12/2003 Bernhart ..... H01R 33/765 439/460
6,773,303 B1 * 8/2004 Lin ..... H01R 9/0521 439/578
7,044,789 B2 * 5/2006 Yohn ..... H01R 9/037 439/599
7,097,486 B2 * 8/2006 Parsons ..... H01R 13/5202 439/291
7,207,820 B1 * 4/2007 Montena ..... H01R 13/5219 439/275
7,435,112 B1 * 10/2008 Miller ..... H01R 13/502 439/133
7,494,377 B2 * 2/2009 Yohn ..... H01R 9/03 439/460
9,553,395 B2 * 1/2017 Nagasaki ..... H01R 13/506

OTHER PUBLICATIONS

Hubbell Wiring Device-Kellems, Twist-Lock Devices 50A, 3 Phase 250V, 3 Pole, 4 Wire Grounding, publicly available before Dec. 2016 (6 pages).

* cited by examiner

ELECTRICAL CONNECTOR WITH CONDUIT ADAPTER

CROSS-REFERENCE TO RELATED APPLICATION

This application claims the benefit of prior-filed, U.S. Provisional Patent Application No. 62/434,654, filed Dec. 15, 2016, the entire contents of which are incorporated by reference herein.

BACKGROUND

The present application generally relates to electrical connectors and more specifically to a conduit adapter for an electrical connector.

SUMMARY

Data racks may receive power via a receptacle mounted in a metallic box. The receptacle is electrically connected to the data racks via conductor wire fed into the box through a conduit connected with the box. The receptacle is connected to the conduit by a conduit fitting assembly or adapter. The receptacle is configured to receive a male connector or plug to electrically connect the data racks with a power source. The connection may transmit up to 50 amperes of current to the data racks, although similar connectors may transmit more or less current. For safety, the connection often must be liquid-tight. The conduit is typically a liquid-tight metallic conduit, and is connected with the receptacle via a fitting. The fitting is often liquid-tight to prevent water from entering the box at the connection between the conduit and the box.

Alternatively, the plug may be connected with a female connector including a female connector body connected with a flexible conduit. The connector may selectively receive the plug to electrically connect the data racks with the power source. However, neither the plug nor the female connector includes a fitting assembly for connecting with a liquid-tight flexible metallic conduit.

In one aspect, an electrical connector for securing a conduit including an electrical conductor includes a housing, an electrical contact, and a conduit fitting assembly for securing the conduit relative to the housing. The housing defines a cavity and an aperture in communication with the cavity, and the aperture is configured to receive the conduit. The electrical contact is supported by the housing and configured to be in electrical communication with the electrical conductor. The conduit fitting assembly threadably engages the housing.

In another aspect, an electrical connection assembly includes a male connector, a female connector, and a conduit fitting assembly. The male connector includes a first housing and a blade contact supported by the housing to extend axially from the housing along a first axis. The female connector includes a second housing and a receptacle contact extending axially into the housing along a second axis. The male and female connectors are axially connectable such that the blade contact is received by the receptacle contact and the first and second axes are coaxial. The male and female connectors are relatively rotatable about the first and second axes between an unlocked position in which the male and female connectors may be axially connected and disconnected, and a locked position in which the male connectors are inhibited from axial movement. The conduit fitting assembly connects a conduit to one of the first and second housings. A conductor of the conduit is electrically connected with a corresponding one of the blade contact and the receptacle contact.

In yet another aspect, a method of assembling an electrical connector includes: inserting a ferrule of a conduit fitting assembly into a first portion of a threaded connector of the conduit fitting assembly and an end of a conduit; threading a nut of the conduit fitting assembly on to the second portion of the threaded connector; compressing the end of the conduit onto the ferrule to couple the conduit to the conduit fitting assembly; and coupling a first portion of a threaded connector of the conduit fitting assembly to a housing via an aperture defined in the housing.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 12:
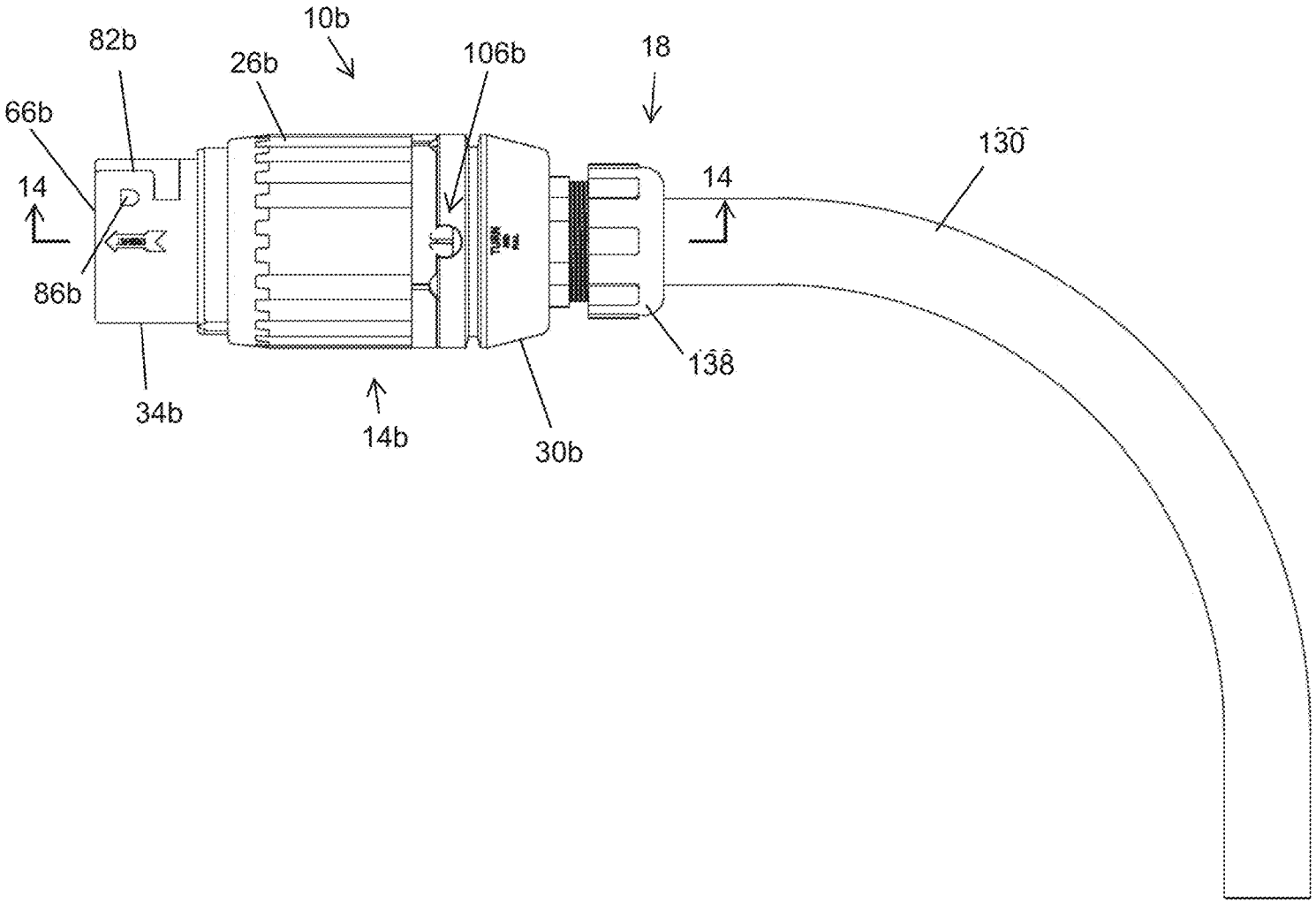
FIG. 12 is a side view of a female connector according to one embodiment.
Figure 13:
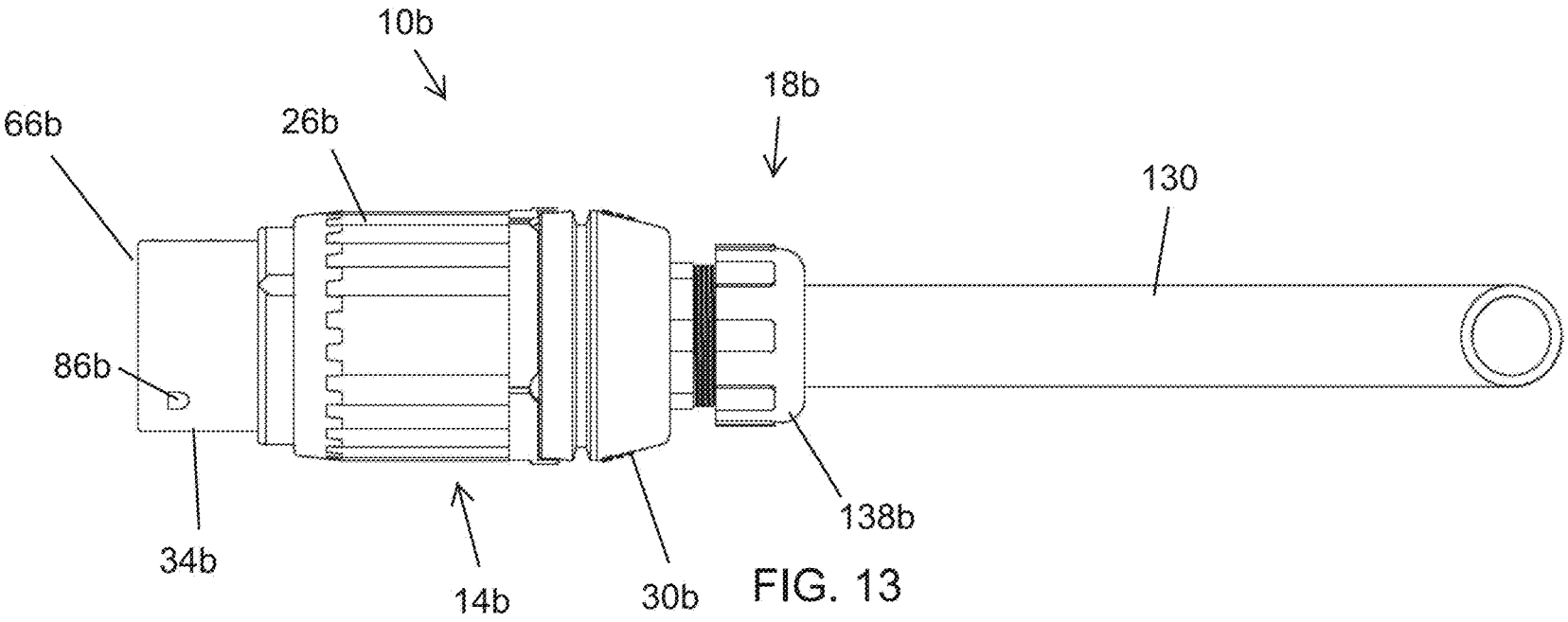
FIG. 13 is a side view of the female connector of FIG. 12.
Figure 14:
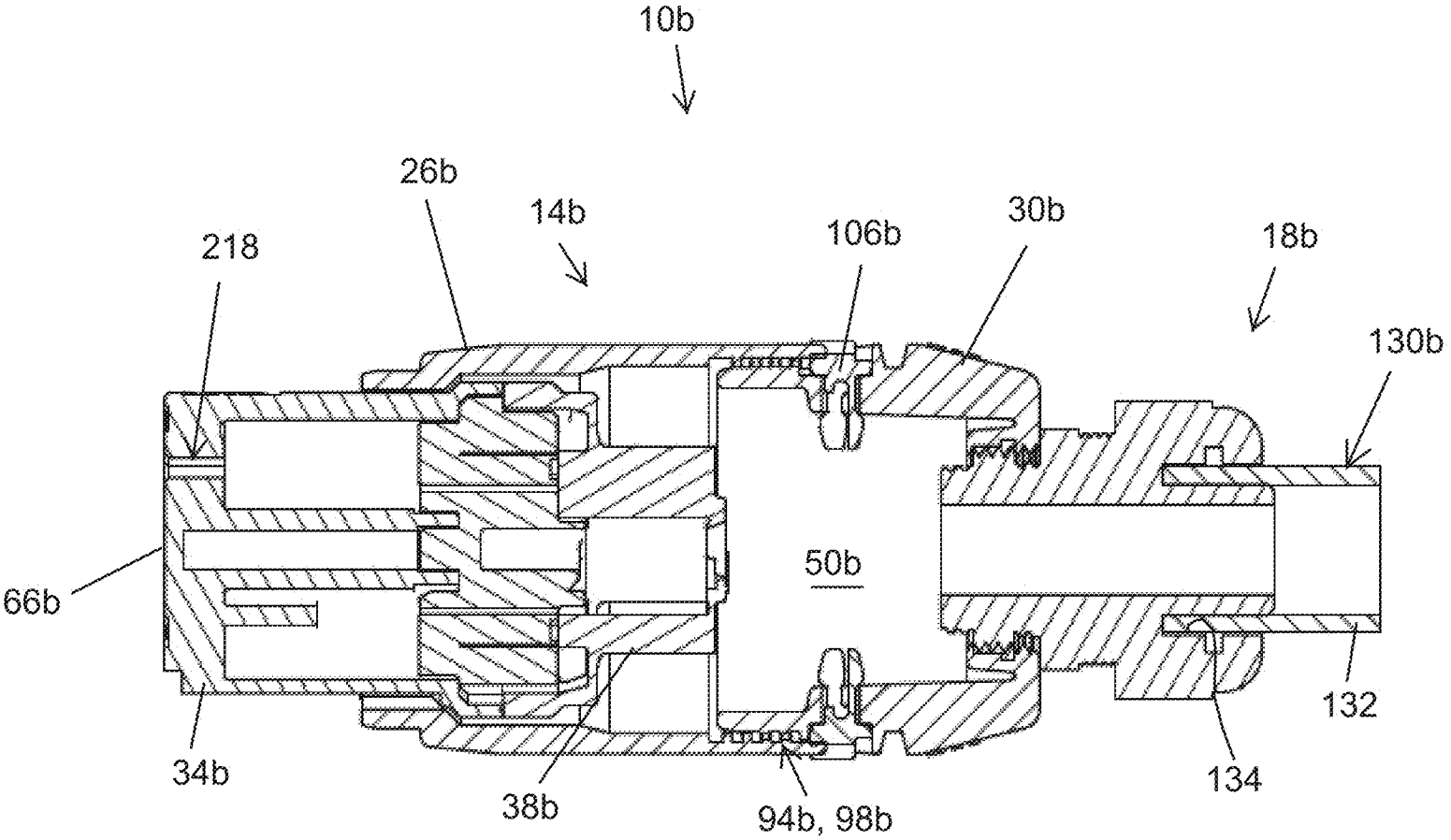
FIG. 14 is a cross-sectional view of the female connector of FIG. 12 viewed along section 14-14.

FIGS. 1-9 illustrate a connector 10 including a connector housing or body 14 and a conduit adapter or conduit fitting assembly 18. The connector body 14 has a longitudinal axis A (FIG. 3) and is generally cylindrical. The illustrated connector 10 is a plug or male connector, in which the connector body 14 is a plug body or male connector body that is configured to mechanically and electrically connect with a female connector 10*b* (e.g., as shown in FIGS. 12-14). The connectors 10, 10*b* are locking type connectors, in which the male and female connectors 10, 10*b* once connected may be locked to prevent accidental disconnection of the cord ends. In the illustrated embodiment, the connectors 10, 10*b* are connected axially along the axis A and locked by rotating the male connector body (i.e., plug body) and the female connector body relative to each other about the axis A.

Figure 3:
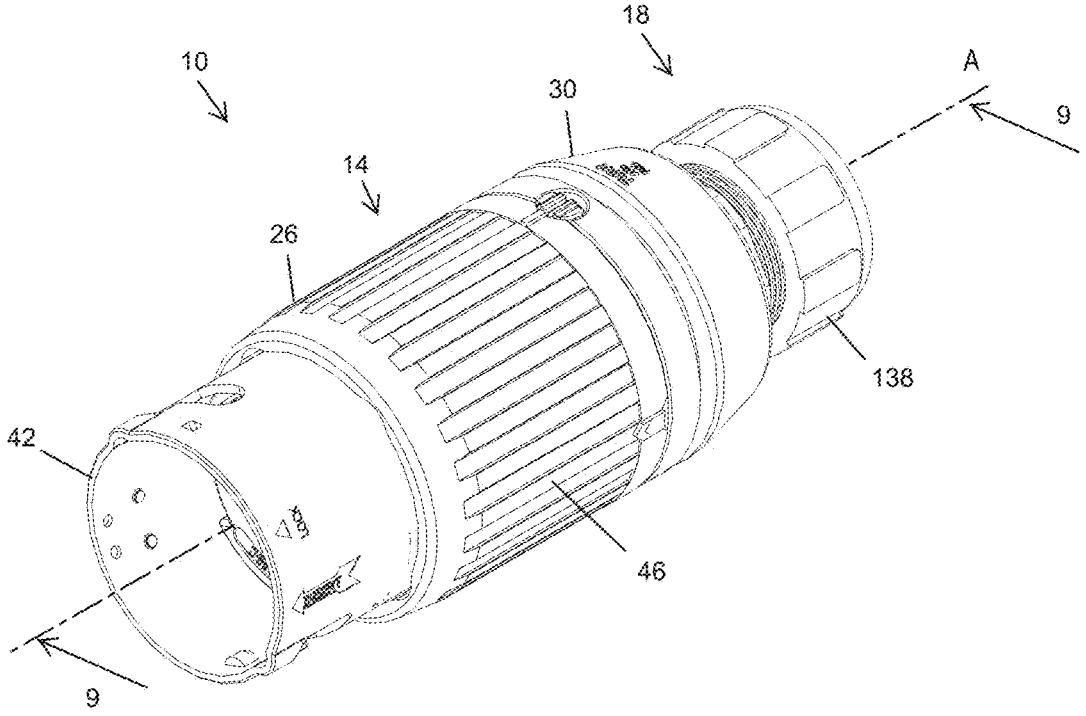
FIG. 3 is a perspective view of the connector of FIG. 1.
Figure 4:
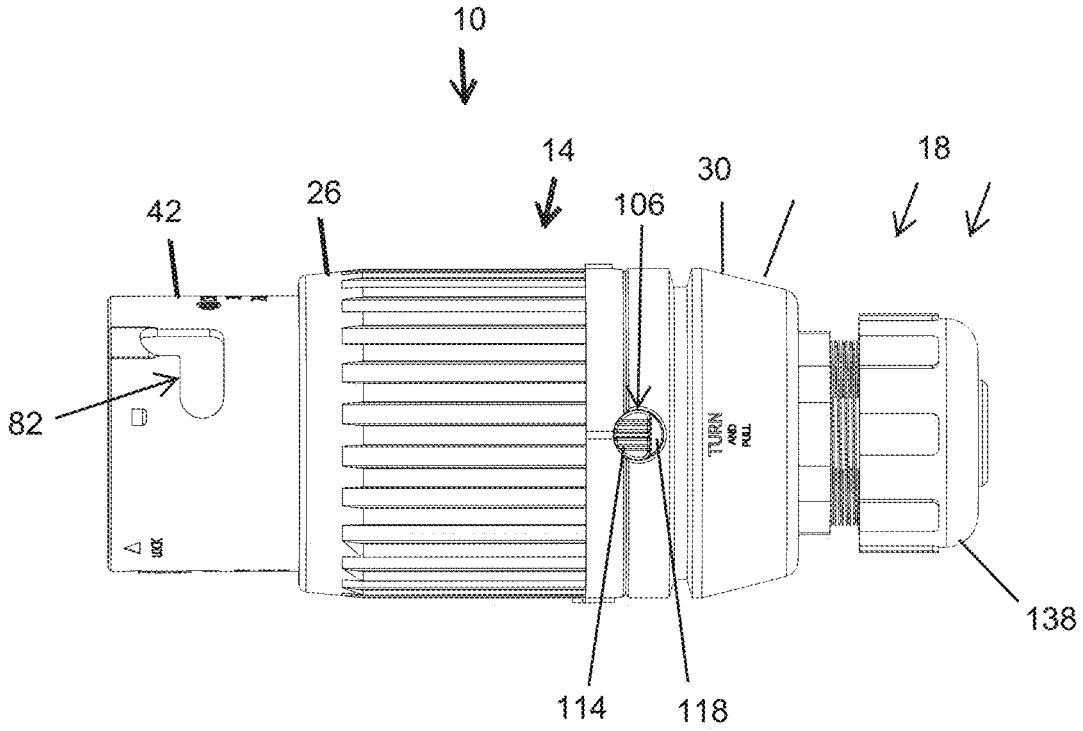
FIG. 4 is a side view of the connector of FIG. 3.
Figure 7:
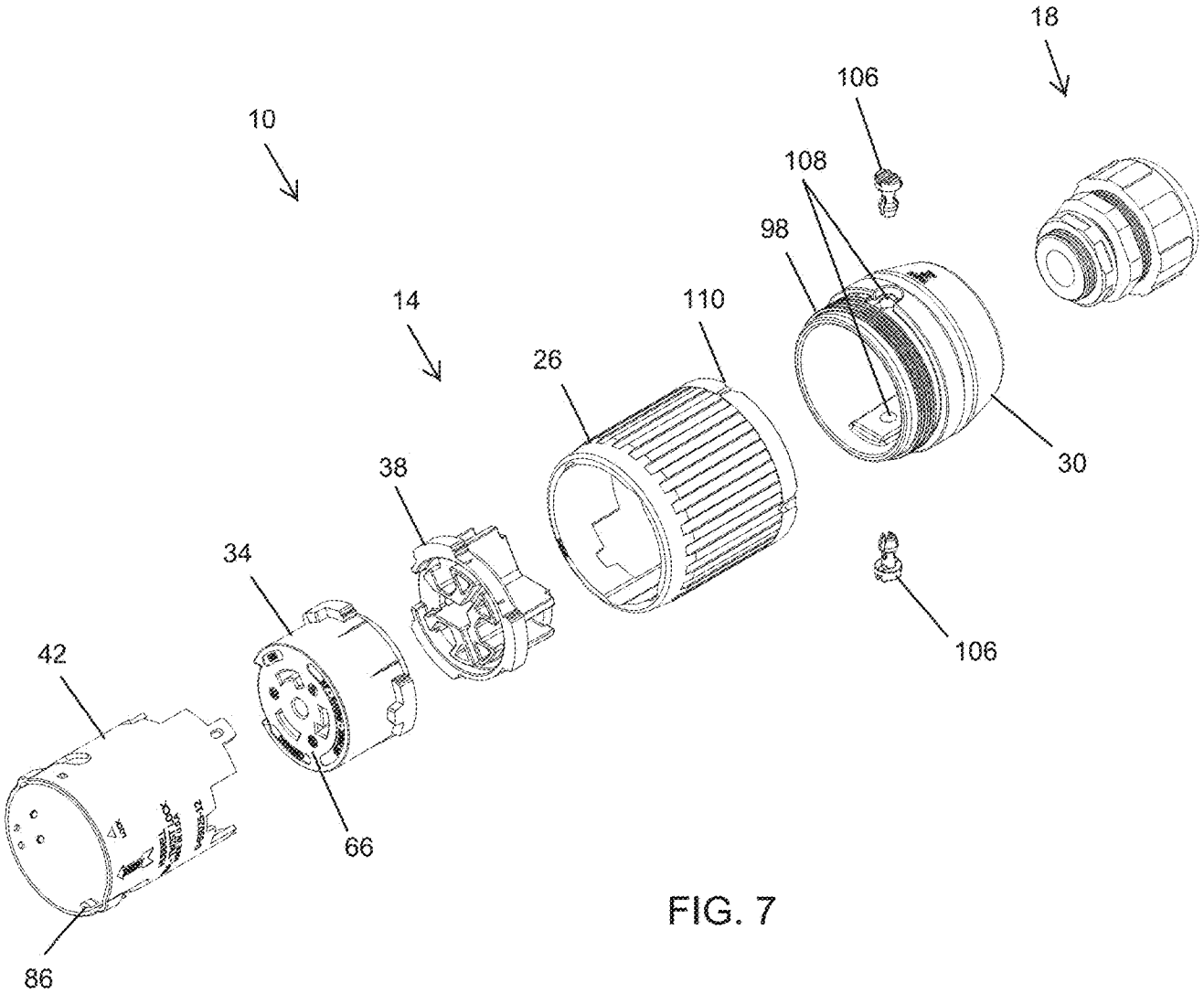
FIG. 7 is an exploded view of the connector of FIG. 3.
Figure 8:
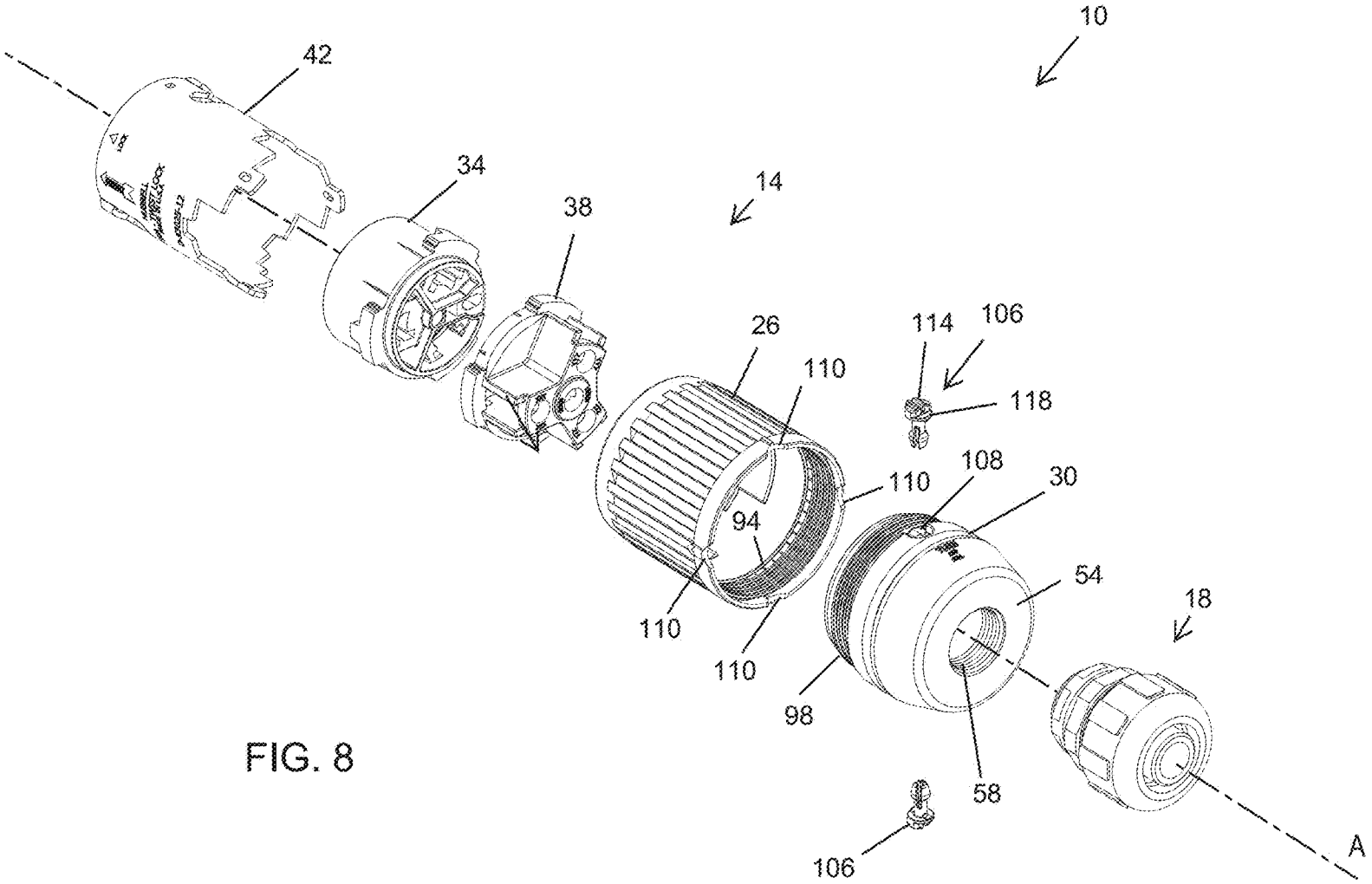
FIG. 8 is another exploded view of the connector of FIG. 3.
Figure 9:
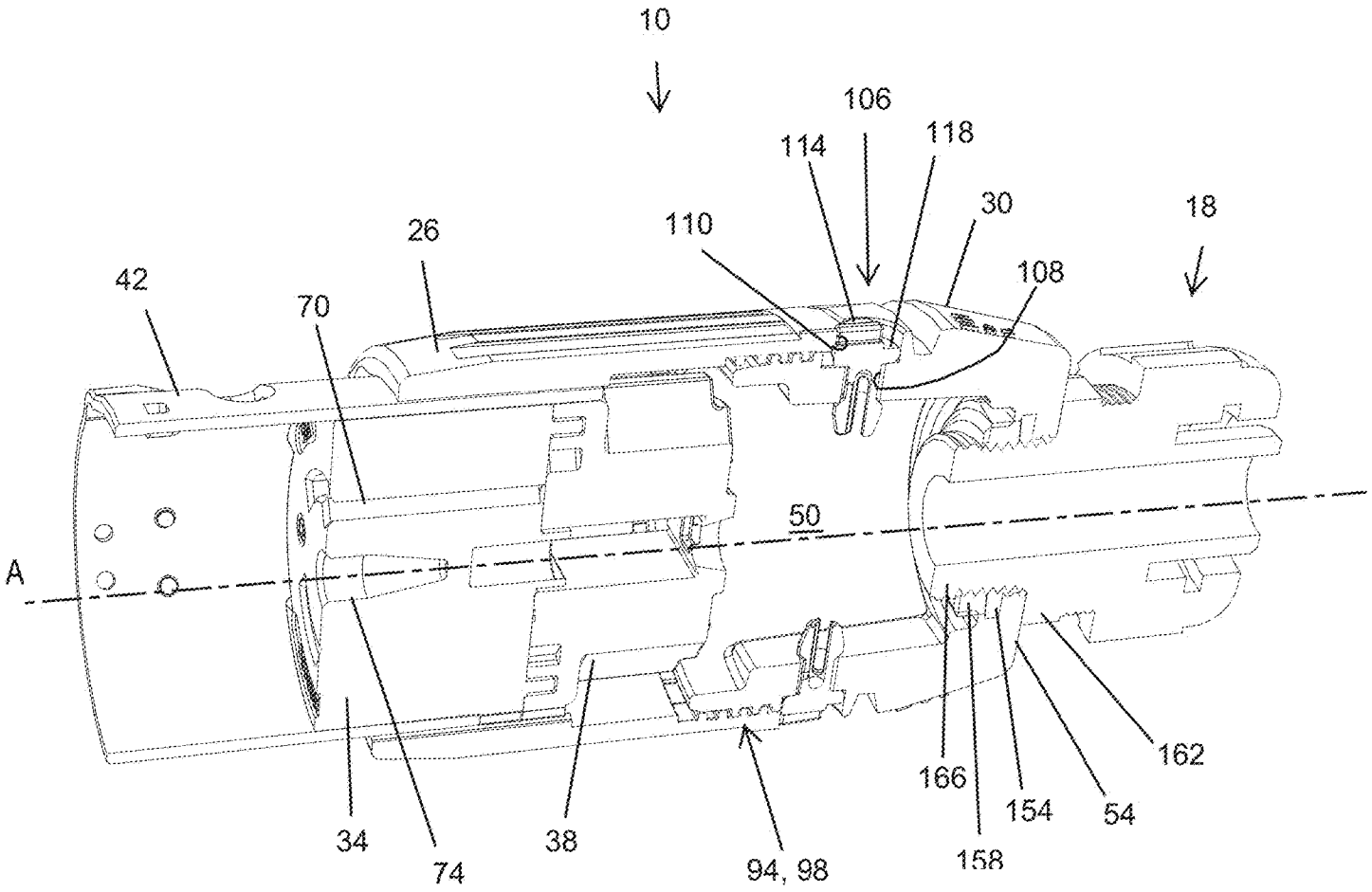
FIG. 9 is a cross-sectional view of the connector of FIG. 3 viewed along section 9-9.

With reference to FIGS. 3, 4 and 7-9, the connector body 14 includes a front housing portion 26, a rear housing portion 30, a front internal portion 34, a rear internal portion 38, and a cylindrical shroud 42. In the illustrated embodiment, the front housing portion 26 includes a cylindrical wall having an outer gripping surface 46 (FIG. 3). Referring to FIG. 9, the front housing portion 26 and the rear housing portion 30 are coupled together and define a cavity 50. The cavity 50 contains the front and rear internal portions 34, 38; in the illustrated embodiment, the front internal portion 34 axially protrudes from the front housing portion 26. A rear wall 54 of the rear housing portion 30 defines a threaded conduit aperture 58 (FIG. 8) extending into the cavity 50. The conduit aperture 58 extends coaxially with the axis A, which is perpendicular to the rear wall 54. The cavity 50 also receives and contains ends of electrical conductors or wires (not shown) fed through the threaded conduit aperture 58. The front and rear housing portions 26, 30 may each be made out of nylon, or another suitable material, to provide impact strength and/or thermal and electrical insulation.

Figure 5:
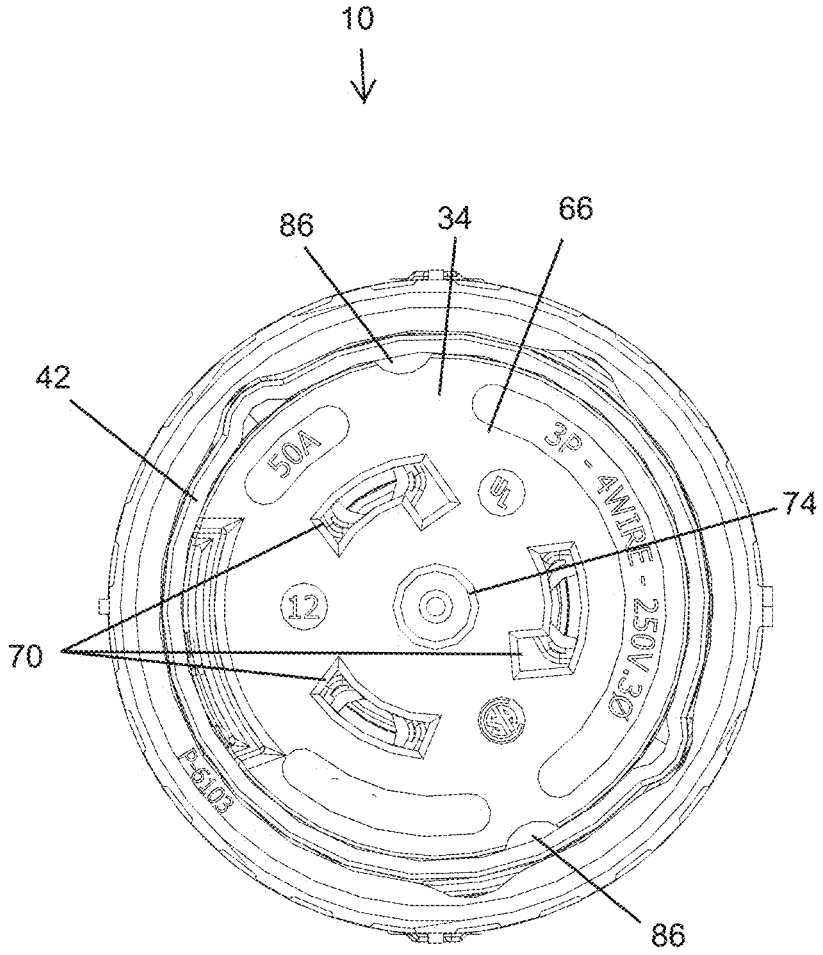
FIG. 5 is a first end view of the connector of FIG. 3.
Figure 6:
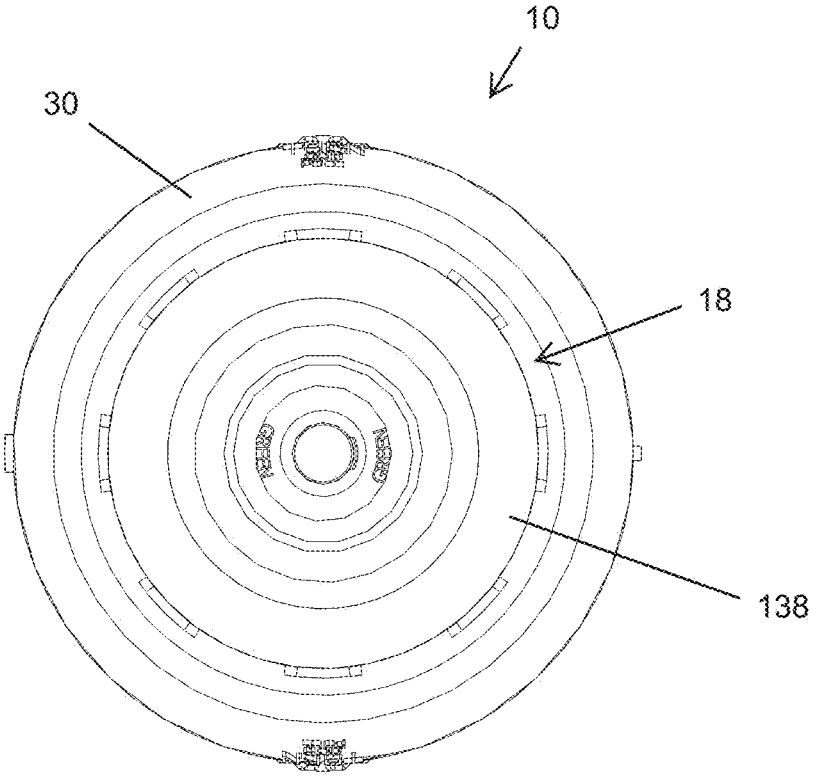
FIG. 6 is a second end view of the connector of FIG. 3.
Figure 9B:
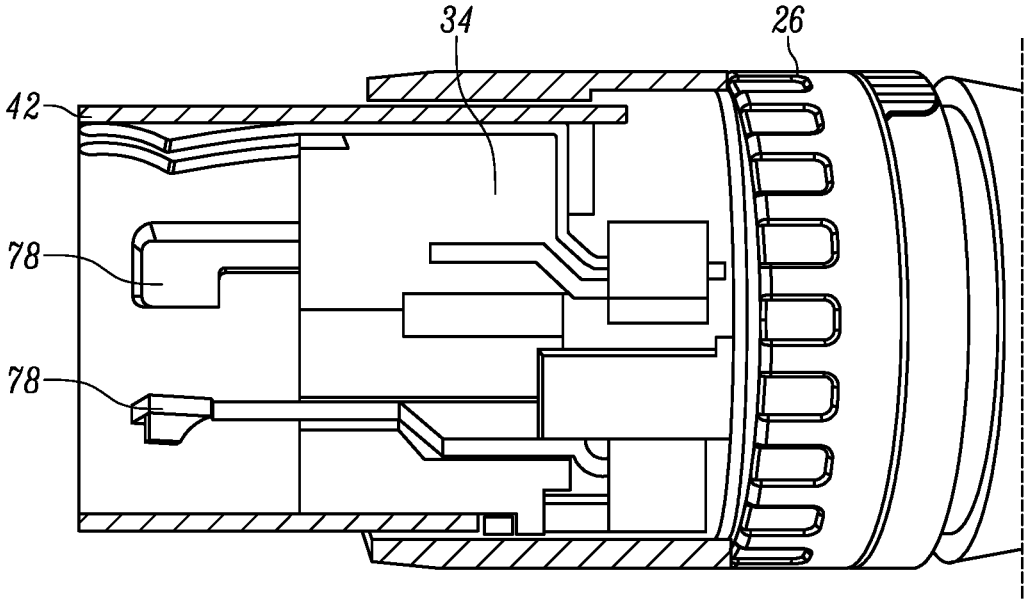
FIG. 9B is a cross-sectional view of a portion of a male connector according to another embodiment.

With reference to FIGS. 5 and 9, the front internal portion 34 has a front face 66 defining three blade contact support passages 70 extending axially through the front internal portion 34 to the rear internal portion 38. In the illustrated embodiment, the support passages 70 are circumferentially spaced about an axially extending central passage 74 that is coaxial with the central axis A (FIG. 9). A corresponding electrical blade contact (not shown) is supported in each support passage 70 and extends from the rear internal portion 38 and projects outwardly from the front face 66. In some embodiments, the blade contacts are similar to the blade contacts 78 shown in FIG. 9B, and the shape and position of the blade contacts may be understood based on the shape and position of the support passages 70 in FIGS. 5 and 7. Each blade contact is electrically connected to a corresponding conductor within the rear internal portion 38 in the cavity 50. In some embodiments, there may be fewer or more blade contacts. The front internal portion 34 may be made out of thermoplastic polyester, or another suitable material, to provide heat resistance and/or high impact strength.

With reference to FIGS. 3-5 and 7-9, the shroud 42 is positioned between the front housing portion 26 and the front internal portion 34 and extends around the blade contacts extending from the front internal portion 34. The shroud 42 protects the blade contacts from being accidently damaged or bent. In some embodiments, the shroud defines a pair of locking channels 82 that are "L" shaped, and has a pair of locking detents 86 (FIG. 5) that each project radially inward. The shroud 42 may prevent a user from attempting to connect the connector 10 with an inappropriate electrical device or connector. The shroud 42 may also be capable of receiving a padlock to prevent the connector 10 from being disconnected.

With continued reference to FIGS. 7-9, the front housing portion 26 and the rear housing portion 30 have corresponding threads 94, 98 for selectively coupling the front and rear housing portions 26, 30 together. Accordingly, a user may quickly disconnect the front and rear housing portions 26, 30 to access the cavity 50 for wiring or re-wiring the conductors to the blade contacts. The connector 10 further includes two pivoting latch members 106 received in a pair of bores 108 positioned in the rear housing portion 30 and adjacent the threads 98. In the illustrated embodiment, each bore 108 is oriented radially with respect to the axis A and the bores 108 are spaced 180 degrees apart from one another.

Each latch member 106 includes a raised portion 114 and a recessed portion 118. Each latch member 106 is also adjacent and engages an associate recess 110 positioned along an edge of at least one of the housing portions (e.g., the front housing portion 26). Each latch member 106 is pivotable between a first, locking position, in which the raised portion 114 is received in the recess 110 (see FIG. 3), and a second, unlocking position, in which the recessed portion 118 is received in the recess 110 and the raised portion 114 is not. When at least one of the latch members 106 is in the locking position, the raised portion 114 extends into the recess 110 to prevent the front housing portion 26 from being rotated relative to the rear housing portion 30. When both of the latch members 106 are in the unlocked position, the recessed portions 118 are positioned in the recesses 110, allowing the front housing portion 26 to rotate relative to the rear housing portion 30 to unthread and disconnect the front and rear housing portions 26, 30. In the illustrated embodiment, each of the latch members 106 defines a slot that may receive a standard flat-blade screwdriver in order to rotate the latch members 106.

Figure 1:
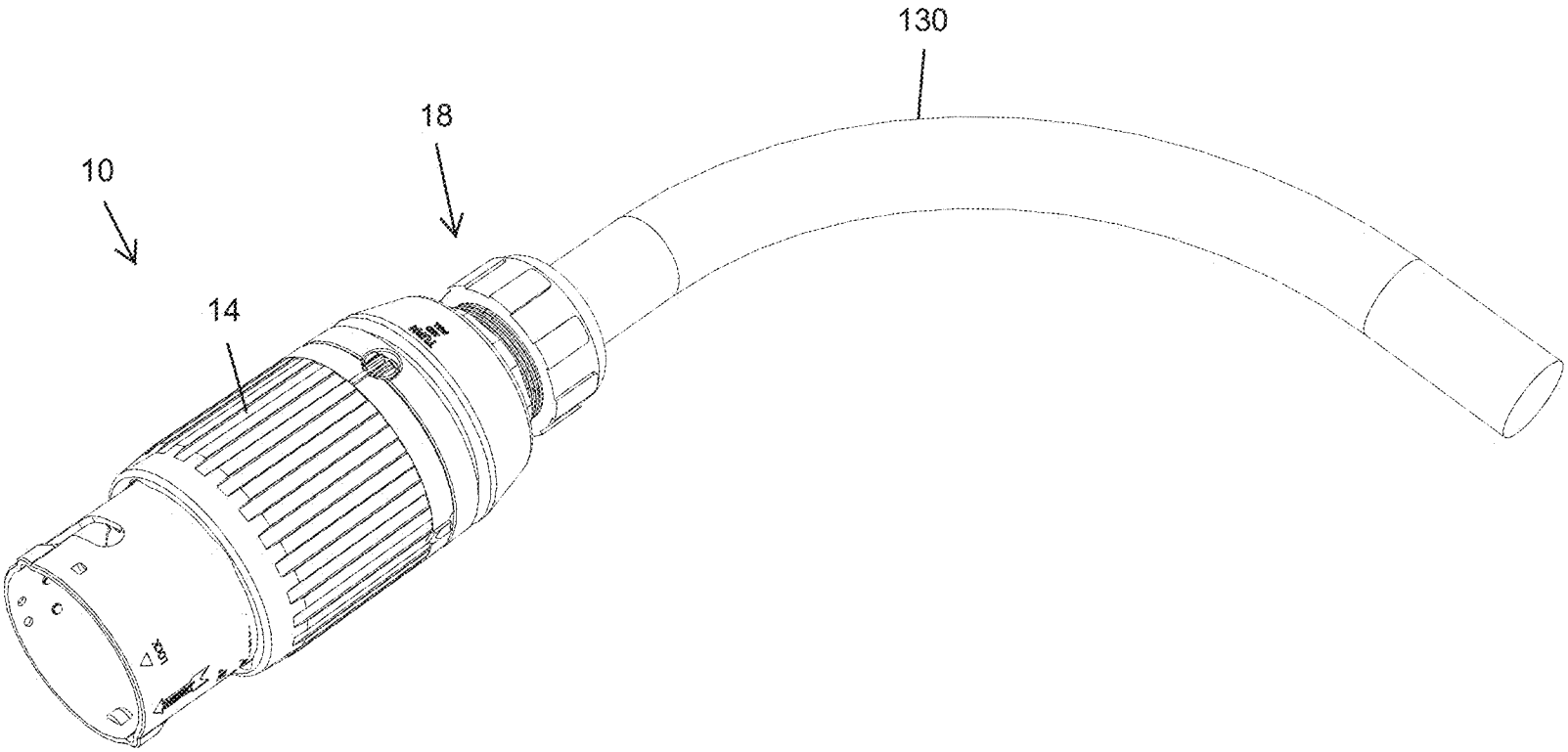
FIG. 1 is a perspective view of a male connector and a conduit.
Figure 2:
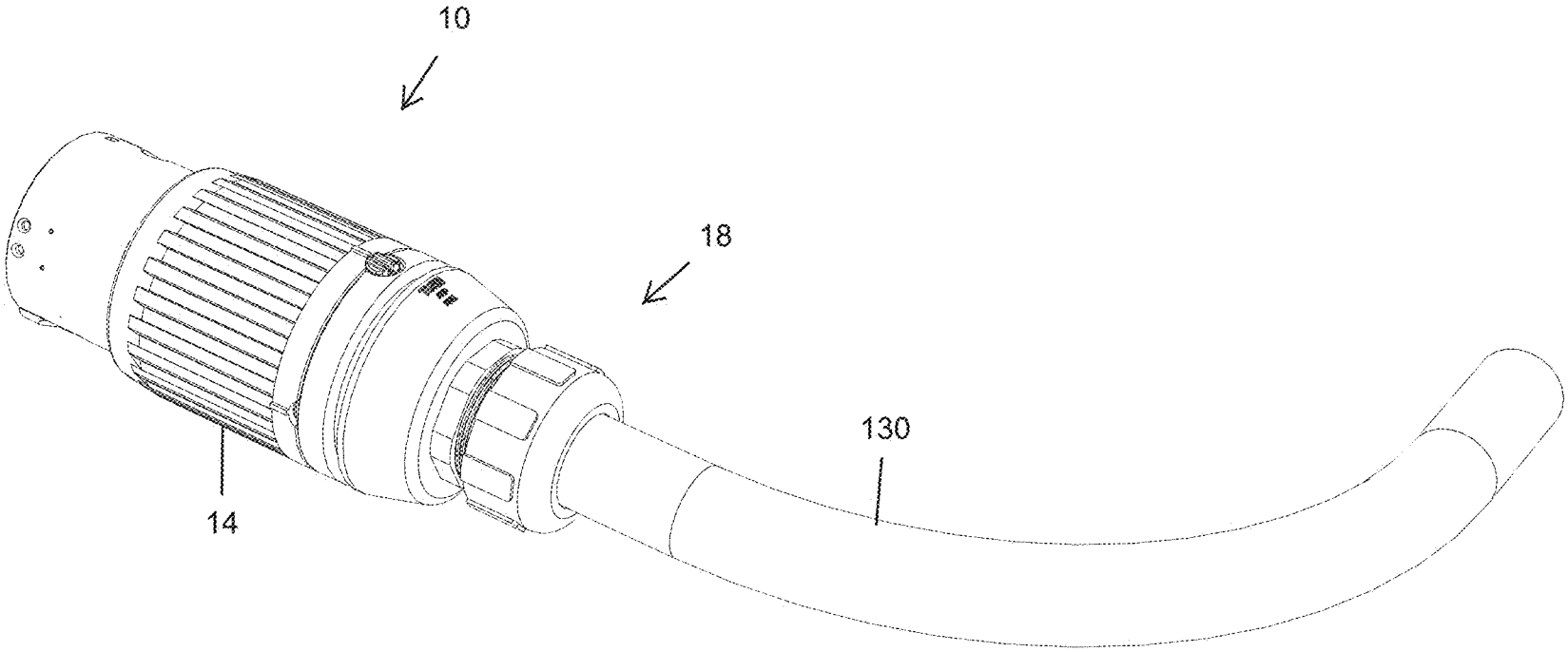
FIG. 2 is another perspective view of the connector and the conduit of FIG. 1.

With reference to FIGS. 1-2 and 9, the conduit fitting assembly 18 mechanically connects a conduit 130 to the connector body 14. The conduit fitting assembly 18 is coupled to the rear housing portion 30 via the conduit aperture 58 defined therein. In some embodiments, the conduit 130 includes a cover or sheath enclosing conducting wires or conductors (see e.g., FIG. 14) that pass into the rear housing portion 30 through the conduit fitting assembly 18. In the illustrated embodiment, the conduit 130 is a liquid-tight flexible metallic conduit. The conduit 130 includes a waterproof plastic coating to inhibit liquid entering the conduit 130 and contacting the conductors. The conduit fitting assembly 18 provides a liquid-tight connection between the connector body 14 and the conduit 130. In other embodiments, the conduit 130 is a flexible conduit, a flexible metallic conduit, or another suitable conduit (e.g., rigid or flexible metallic conduit, or rigid or flexible plastic conduit).

Figure 10:
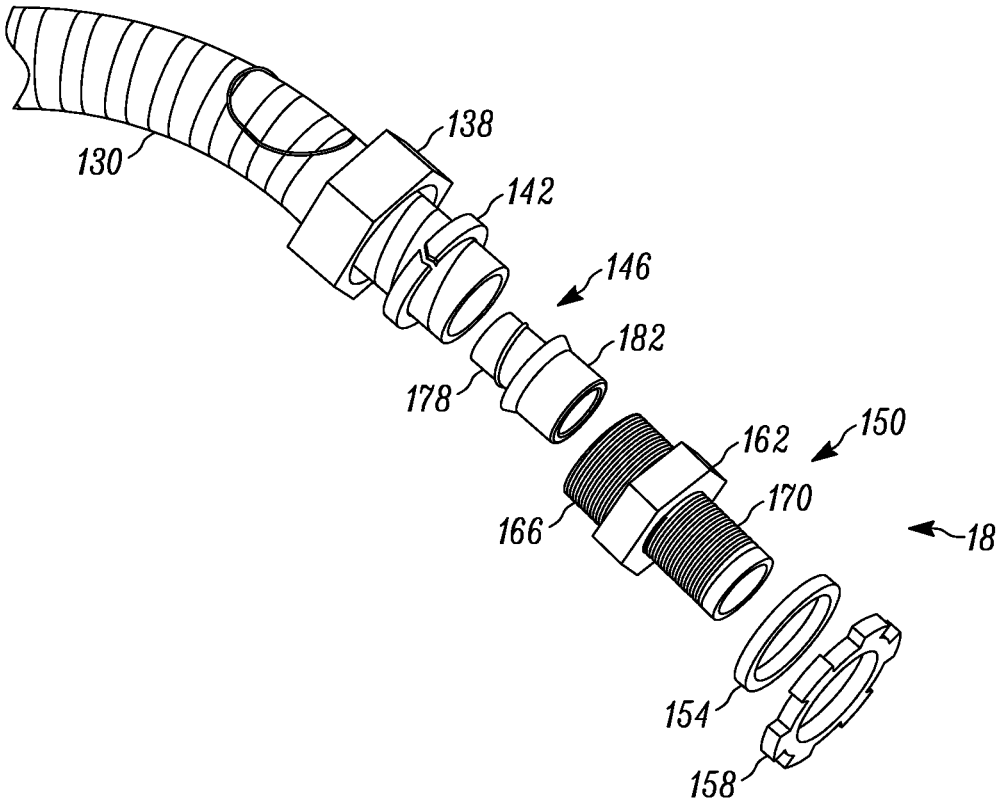
FIG. 10 is an exploded view of a conduit fitting assembly.

With reference to FIG. 10, the conduit fitting assembly 18 includes a nut 138, a split gland-ring 142, a ferrule 146, a hollow threaded connecting member 150, a gasket 154, and a locknut 158. The threaded connecting member 150 includes a central flange 162, and first and second threaded portions 166, 170 each extending axially from opposite sides of the central flange 162. The threaded connecting member 150 defines a bore passing axially therethrough. In the illustrated embodiment, the first threaded portion 166 has a first diameter and the second threaded portion 170 has a second, smaller diameter. The ferrule 146 has first and second ends 178, 182 and a bore passing axially therethrough. The second end 182 of the ferrule 146 is sized to be received within the first threaded portion 166 of the threaded connecting member 150. The first end 178 of the ferrule 146 is sized to be received within the end of the conduit 130 and is sealed from liquid by the gland-ring 142, which compresses the conduit 130 onto the ferrule 146 via the nut 138.

The nut 138 has cavity threads corresponding to threads on the first threaded portion 166 of the threaded connecting member 150. In the illustrated embodiment, the nut 138 has a hexagonal outer profile that may be rotatable manually or by a standard wrench. In some embodiments, the nut 138 may have a gripping profile conducive to manually tightening the nut 138, such as the compression nut 138*a* illustrated in FIG. 11. In the illustrated embodiment, the nut 138, the ferrule 146, the threaded connecting member 150, and the locknut 158 are made of steel, and the gland-ring 142 and the gasket 154 are made of nylon. In some embodiments, the nut 138, the ferrule 146, the threaded connecting member 150, and the locknut 158 may be made of another suitable material, such as plastic (e.g., nylon). In some embodiments, the gland-ring 142 and the gasket 154 may each be made of another suitable material.

The second threaded portion 170 of the threaded connecting member 150 has threads corresponding to threads of the conduit aperture 58 in the rear housing portion 30. As best illustrated in FIG. 9, the rear housing portion 30 is clamped between the central flange 162 and the locknut 158, which is received within the cavity 50 and threaded onto the second threaded portion 170 of the threaded connecting member 150 to secure the threaded connecting member 150 to the rear housing portion 30. The gasket 154 is positioned between the locknut 158 and the rear housing portion 30 to provide a liquid-tight seal at this connection. In some embodiments, the gasket 154 or an additional gasket may be positioned between the rear wall 54 and the central flange 162.

Figure 11:
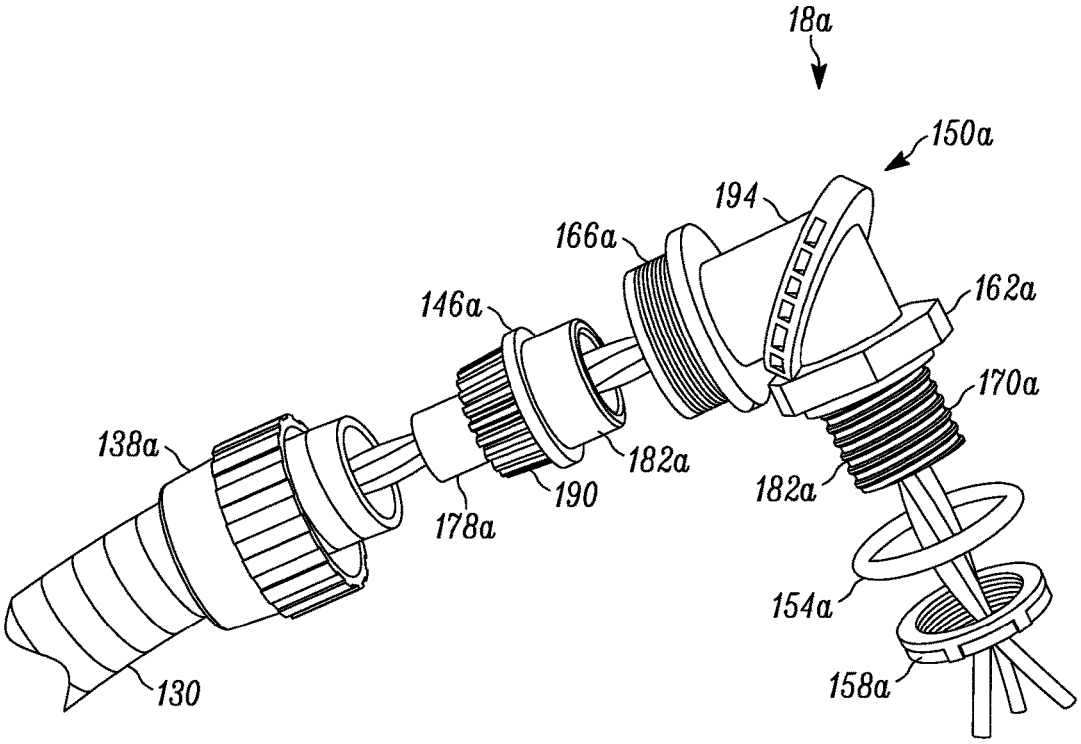
FIG. 11 is an exploded view of a conduit fitting assembly according to another embodiment.

In some embodiments, the conduit fitting assembly 18 may be a non-metallic conduit fitting assembly 18*a*, as shown in FIG. 11. The fitting assembly 18*a* is substantially similar to the conduit fitting assembly 18 shown in FIG. 10. Accordingly, similar features are identified with like reference numerals plus "a" and only differences are described in detail below. The primary difference is that the components of the fitting assembly 18*a* are each made of plastic (e.g., the nut 138*a* and the locknut 158*a* of FIG. 14 are each made of nylon instead of steel). In the illustrated embodiment, the ferrule 146*a* also provides an integral conduit seal 190 in addition to, or in lieu of, the gland-ring 142. The conduit seal 190 includes a plurality of teeth, and when the nut 138*a* is threaded onto first threaded portion 166*a* the nut 138*a* compresses the teeth radially inward to compress and grip the conduit 13*a*. In addition, the threaded connecting member 150*a* of the non-metallic fitting assembly 18*a* includes a two-piece swivel body 194 connecting the first and second threaded portions 166*a*, 170*a*. The swivel body allows the first and second threaded portions 166*a*, 170*a* to be pivotal between a first, 0 degree position in which the first and second threaded portions 166*a*, 170*a* are coaxially aligned, and a second, 90 degree position in which the first and second threaded portions 166*a*, 170*a* are perpendicular.

The connector 10 may be coupled with a female connector 10*b* (FIG. 12), or may be coupled to a conventional mating connector. Instead of a cord clamp mechanism that includes clamps or jaws for gripping a conduit, FIGS. 12-14 illustrates a female connector 10*b* including a female connector body 14*b*. The female connector 10*b* is substantially similar to the male connector 10 of FIGS. 1-9. Accordingly, similar features are identified with similar reference numerals plus "b" and only differences are described in detail below.

Figure 14B:
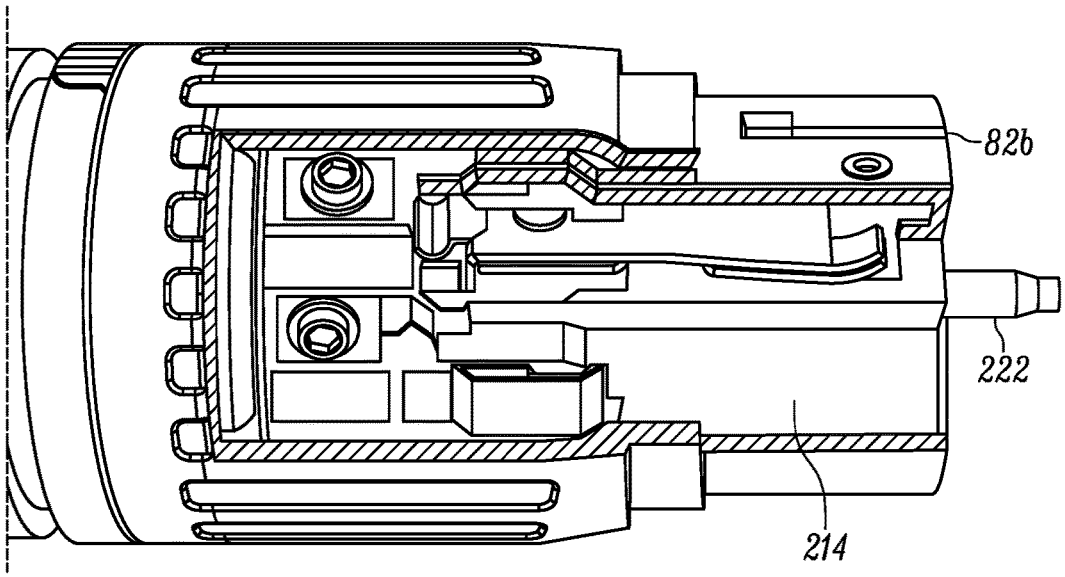
FIG. 14B is a cross-sectional view of a portion of a female connector according to another embodiment.

As shown in FIG. 14, front and rear internal portions 34*b*, 38*b* include receptacle passages 218*b* for supporting receptacle contacts 214 (FIG. 14B) that electrically connect with the blade contacts of a male connector 10. The receptacle passages 218*b* extend through the front face 66*b* of the front internal portion 34*b* corresponding to and sized to receive blade contacts. In some embodiments, the receptacle contacts 214 can include at least one leaf spring member biased to clamp the blade contacts 78 (FIG. 9B) received within the receptacle passages 218.

Similar to the blade contacts of the male connector 10, conductors fed into the cavity 50*b* of the female connector 10*b* are electrically connected to the receptacle contacts. Accordingly, when the male connector 10 is axially connected to the female connector 10*b* such that the blade contacts are received in the receptacle passages 218, the conductors of the male and female connectors 10, 10*b* are electrically connected. Also, in some embodiments a central projection 222 (FIG. 14B) protrudes axially from the front face 66*b* of the front internal portion 34*b* and is received within the central passage 74 of the male connector 10 when the male and female connectors 10, 10*b* are connected.

As shown in FIG. 12, the front internal portion 34*b* includes a pair of locking channels 82*b*. In the illustrated embodiment, each channel 82*b* has an "L" shape. Each locking channel 82*b* corresponds to one of the locking detents 86 (FIG. 5) of the male connector 10. The front internal portion 34*b* also has a pair of locking detents 86*b* extending radially outward from the front internal portion 34*b*. Each locking detent 86*b* corresponds to one of the locking channels 82 (FIG. 5) of the male connector 10. The receptacle passages 218 (FIG. 14) and the blade contacts are configured such that the male and female connectors 10, 10*b* may be rotated relative to one another about the central axes A of the connectors (which are coaxial when connected) from an unlocked position into a locked position.

In the locked position, the detents 86 are received within laterally extending portions of the associated locking channels 82*b*, and the detents 86*b* are received in laterally extending portions of the associated locking channels 82. Stated another way, each laterally extending portion is oriented in a plane that is oriented at an oblique angle (e.g., perpendicular) to the axes A such that the male and female connectors 10, 10*b* are secured from axially movement and disconnection. In the unlocked position, the detents 86 are positioned in axially extending portions of the locking channels 82*b* and the detents 86*b* are positioned in axially extending portions of the locking channels 82. In the unlocked position, the detents 86, 86*b* are permitted to slide axially within portions of the locking channels 82, 82*b* parallel to the axes A and the male and female connectors 10, 10*b* may be axially connected and disconnected freely. The locking detents 86, 86*b* and the locking channels 82, 82*b* of the male and female connectors 10, 10*b* provide a bayonet-style connection to secure the male and female connectors 10, 10*b* together from axial disconnection. In combination, the male and female connectors 10, 10*b* are an electrical connection assembly for connecting electrical devices (e.g., data racks with a power source).

Instead of a cord clamp assembly, the connector body 14*b* includes a conduit fitting assembly 18*b* for connecting a liquid-tight flexible metallic conduit to the connector body 14*b* similar the male connector 10 of FIGS. 1-9.

Although the plug or male connector 10 and the female connector 10*b* are each described and illustrated as being connectable with each other, each of the connectors 10, 10*b* may also be electrically and mechanically connectable with a receptacle assembly (not shown) including a box and mounting plate.

During assembly of the connector 10, the conduit 130 is coupled to the rear housing portion 30 by the conduit fitting assembly 18. Specifically, a nut 138 is fed onto the free end of the conduit 130. The first end 178 of the ferrule 146 is inserted into the end of the conduit 130, and the second end 182 of the ferrule 146 is inserted into the first threaded portion 166 of the threaded connecting member 150. The nut 138 is then threaded on to the first threaded portion 166 of the threaded connecting member 150 compressing the gland-ring 142 on to the conduit 130 to compress the conduit 130 on the first end 178 of the ferrule 146. The second threaded portion 170 of the threaded connecting member 150 is threaded into the thread conduit aperture 58 of the rear housing portion 30. This may be prior to or after the first threaded portion 166 is threaded into the nut 138. The gasket 154 is then positioned on the second threaded portion 170 of the threaded connecting member 150 and clamped between the rear wall 54 of the rear housing portion 30 around the conduit aperture 58 and the locknut 158 threaded onto the second threaded portion 170. Assembly of the connector 10 using the conduit fitting assembly 18*a* of FIG. 11 is substantially similar to that described above.

The conductor wires are fed through the conduit 130 and out the conduit fitting assembly 18 into the cavity 50. An end of the sheath 132 (FIG. 14) of the conduit 130 may be positioned in an annular slot 134 of the conduit fitting assembly 18. The ends of the conductor wires may be directly wired (i.e., electrically connected) to the blade contacts supported by the front and rear internal portions 34, 38. The shroud 42 and the front and rear internal portions 34, 38 supporting the blade contacts are then inserted into the front housing portion 26, such that the blade contacts extend outwardly from the front face 66 parallel to the axis A.

To close the cavity 50 of the connector 10 for use, the front housing portion 26 and the rear housing portion 30 are coupled together. Specifically, while each of the latch members 106 are in the unlocking position, the front housing portion 26 is threaded onto the rear housing portion 30. When the recesses 110 in the front housing portion 26 are adjacent the latch members 106, the latch members 106 are pivoted into the locking position to secure the front housing portion 26 to the rear housing portion 30. To open the connector 10 for rewiring or repairs, the latch members 106 are pivoted into the unlocking position, and then the front housing portion 26 and the rear housing portion 30 are unthreaded from one another.

Assembly of a female connector 10*b* with a conduit fitting assembly similar to the conduit fitting assembly 18 of FIGS. 1-9 is substantially similar to the assembly process for the male connector 10 described above.

Once assembled, the male connector 10 and the female connector 10*b* can be connected by axially aligning the blade contacts of the male connector 10 with the corresponding receptacle passages 218 of the female connector 10*b*. The male and female connectors 10, 10*b* are then axially connected by inserting the corresponding blade contacts into the receptacle passages 218, and the central projection can extend into the central passage 74, such that the front internal portion 34 of the female connector 10*b* is received within the shroud 42. The locking detents 86, 86*b* of the male and female connectors 10, 10*b* are axially received in the corresponding locking channels 82, 82*b* of the male and female connectors 10, 10*b*, while in the unlocked position. Once connected, the connectors 10, 10*b* may be rotated or twisted about the axis A relative to each other into the locked position to secure the male and female connectors 10, 10*b* from axial disconnection. While connected, the blade contacts 78 are received by the receptacle contacts 214 to form an electrical connection between the conductors of the male connector 10 and the female connector 10*b*, thereby electrically connecting corresponding electrical devices. The same connection process is utilized when connecting either of the male or female connectors 10, 10*b* with a corresponding receptacle assembly 238.

In general, a locking connector is provided including a conduit fitting assembly for connecting a liquid-tight conduit to the locking connector. The connector is adapted to connect the liquid-tight conduit and provide advantages over a receptacle assembly. For example, there are fewer components involved in making the connector with the conduit fitting assembly than a corresponding receptacle assembly. There is also more consistency between components of the male and female connectors, so that entirely different parts do not need to be made for the receptacle and the plug.

Figure 15:
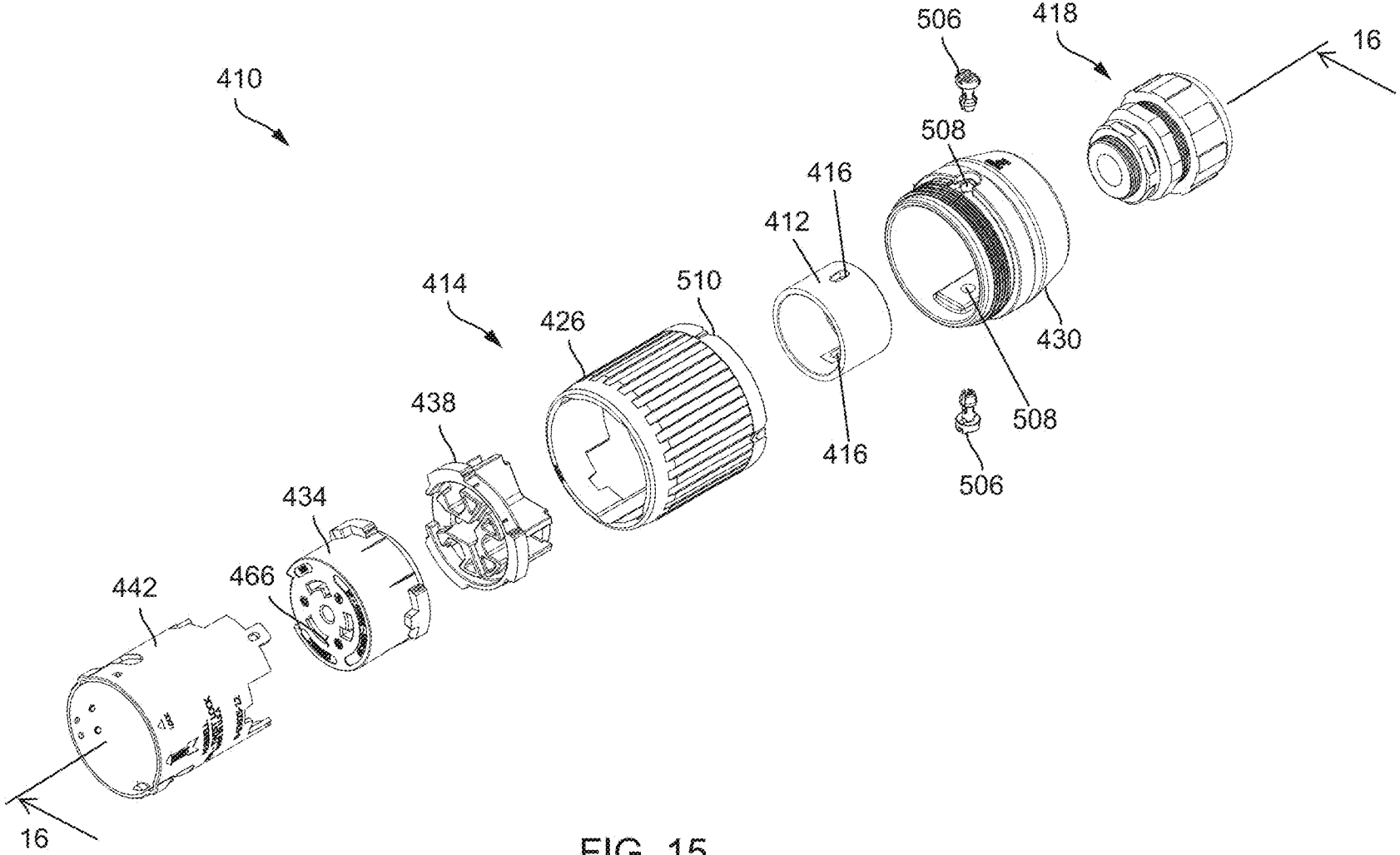
FIG. 15 is an exploded view of a connector according to another embodiment.
Figure 16:
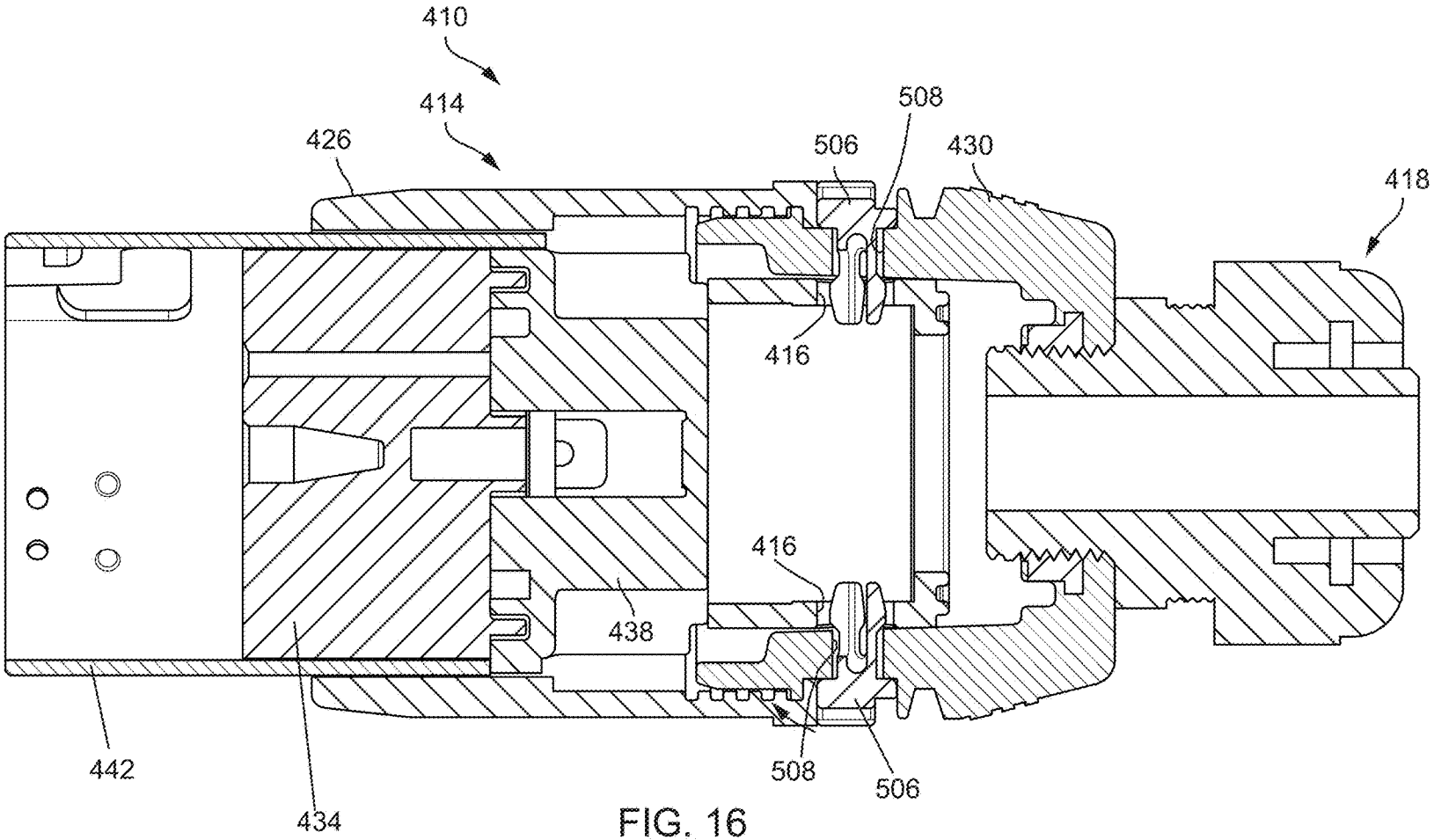
FIG. 16 is a cross-sectional view of the connector of FIG. 15 viewed along section 16-16.

FIGS. 15 and 16 illustrate a connector according to another embodiment. The connector 410 is similar to the connector 10*b* discussed above, and similar features are identified with similar reference numbers, plus 400. The connector 410 includes a sleeve 412 positioned within a rear housing portion 430. The sleeve 412 includes a pair of slots 416, each of which is aligned with the bores 508 of the rear housing portion 430. Each latch member 506 is positioned to extend through an associated one of the slots 416, an associated one of the bores 508, and an opening in the front housing portion 426. Among other things, the latch members 506 secure the sleeve 412 within the rear housing portion 430. When the connector 410 is assembled and tightened, an end of the sleeve 412 contacts and presses against the end of a rear internal portion 438, thereby securing the internal portions 434, 438 of the connector 410 against movement toward the rearward end. Although the connector of FIGS. 15 and 16 is illustrated as a male connector, it is understood that the sleeve 412 could be incorporated in a similar manner in a female connector (e.g., connector 10*b*).

Although aspects have been described in detail with reference to certain preferred embodiments, variations and modifications exist within the scope and spirit of one or more independent aspects as described. Various features and advantages are set forth in the following claims.

What is claimed is:

1. An electrical connector for securing a conduit including an electrical conductor, the electrical connector comprising:

a housing defining a cavity and an aperture in communication with the cavity, the aperture configured to receive the conduit;

an electrical contact supported by the housing and configured to be in electrical communication with the electrical conductor; and a conduit fitting assembly for securing the conduit relative to the housing, the conduit fitting assembly threadably engaging the housing, the conduit fitting assembly including a threaded connecting member, a ferrule, and a nut, the threaded connecting member including a first threaded portion, the ferrule received by the conduit and the first threaded portion, and the nut threadably engaging the first threaded portion to couple the conduit to the conduit fitting assembly.

2. The electrical connector of claim 1, wherein the housing includes a first portion and a second portion, the first portion coupled to the conduit fitting assembly, the second portion supporting the electrical contact, the second portion and the first portion coupled to one another by at least one latch member.

3. The electrical connector of claim 2, wherein the housing further includes an electrical contact support portion and a sleeve, the electrical contact support portion positioned at least partially within the second portion, the sleeve at least partially positioned within the first portion, the sleeve coupled to the first portion and the second portion by the at least one latch member, the sleeve engaging an end of the electrical contact support portion.

4. The electrical connector of claim 1, wherein the threaded connecting member further includes a second threaded portion, and wherein the aperture of the housing has threads corresponding to the second threaded portion of the thread connecting member to couple the conduit fitting assembly to the housing.

5. The electrical connector of claim 4, wherein the conduit fitting assembly further includes a second nut coupled to the second threaded portion of the threaded connecting member to secure the conduit fitting assembly to the housing.

6. The electrical connector of claim 5, wherein a gasket is positioned between the housing and one of the second nut and the threaded connecting member.

7. The electrical connector of claim 1, wherein a split ring is positioned on the conduit within the nut and compresses the conduit onto the ferrule.

8. The electrical connector of claim 1, wherein the conduit is a liquid-tight flexible metallic conduit.

9. The electrical connector of claim 1, wherein the electrical connector is connected with a corresponding electrical connector along a longitudinal axis of the housing.

10. The electrical connector of claim 9, wherein the housing includes at least one of a slot and a detent to selectively inhibit axially disconnection of the electrical connector and the corresponding electrical connector.

11. The electrical connector of claim 10, wherein the at least one of the slot and the detent selectively inhibit axially disconnection of the electrical connector and the corresponding electrical connector by rotating the housing about the axis relative to the corresponding electrical connector.

12. The electrical connector of claim 1, wherein the housing is substantially cylindrical.

13. The electrical connector of claim 1, wherein the housing extends along a longitudinal axis, and wherein the aperture is coaxial with the axis.

14. An electrical connection assembly comprising;

a male connector including a first housing and a blade contact supported by the housing to extend axially from the housing along a first axis;

a female connector including a second housing and a receptacle contact extending axially into the housing along a second axis, the male and female connectors are axially connectable such that the blade contact is received by the receptacle contact and the first and second axes are coaxial, and the male and female connectors are relatively rotatable about the first and second axes between an unlocked position in which the male and female connectors may be axially connected and disconnected, and a locked position in which the male connectors are inhibited from axial movement; and a conduit fitting assembly for connecting a conduit to one of the first and second housings, a conductor of the conduit being electrically connected with a corresponding one of the blade contact and the receptacle contact, the conduit fitting assembly including a threaded connecting member and a nut, the threaded connecting member including a first threaded portion and a second threaded portion, the nut threadably engaging the first threaded portion to couple the conduit to the conduit fitting assembly, the one of the first housing and the second housing including an aperture having threads threadably engaging the second threaded portion.

15. The electrical connection assembly of claim 14, wherein the conduit is a liquid-tight flexible metallic conduit.

16. The electrical connection assembly of claim 14, wherein each of the first housing and the second housing is substantially cylindrical.

17. The electrical connection assembly of claim 14, further comprising a second conduit fitting assembly connecting a second conduit to the other of the first and second housings, and wherein a second conductor is fed through the second conduit and electrically connected with the other of the blade contact and the receptacle contact.

18. The electrical connection assembly of claim 17, wherein each of the first conduit and the second conduit is a metallic liquid-tight conduit.

19. The electrical connection assembly of claim 14, wherein the male connector includes one of a slot and a detent and the female connector includes the other of the slot and the detent, and wherein the slot and the detent engage in the locked position to inhibit axial movement between the male and female connectors.

20. A method of assembling an electrical connector, the method comprising the steps of:

inserting a ferrule of a conduit fitting assembly into a first portion of a threaded connector of the conduit fitting assembly and an end of a conduit;

threading a nut of the conduit fitting assembly on to the second portion of the threaded connector;

compressing the end of the conduit onto the ferrule to couple the conduit to the conduit fitting assembly;

coupling a first portion of a threaded connector of the conduit fitting assembly to a housing via an aperture defined in the housing;

threading the first portion of the threaded connector into the aperture; and threading a second nut onto the first portion to secure the conduit fitting assembly to the housing.

21. The method of claim 20, further comprising positioning a gasket between the housing and the locknut to seal the aperture from liquid leaking into the housing around the first portion of the threaded connector.

22. The method of claim 20, wherein the conduit is a liquid-tight flexible metallic conduit.

23. The method of claim 20, further comprising feeding a conductor through the conduit into an interior of the housing via the conduit fitting assembly, and connecting the conductor to an electrical contact.

24. The method of claim 20, further comprising coupling a first housing portion to a second housing portion.

* * * * *